US005092498A

United States Patent [19]

Willems et al.

[11] Patent Number: 5,092,498

[45] Date of Patent: Mar. 3, 1992

[54] DETACHABLE POURING SPOUT

[75] Inventors: Dale D. Willems; William J. Votruba, both of Hutchinson, Kans.

[73] Assignee: SnapCo, Inc., Hutchinson, Kans.

[21] Appl. No.: 568,603

[22] Filed: Aug. 16, 1990

[51] Int. Cl.[5] ..... B67D 3/00

[52] U.S. Cl. ..... 222/526; 222/568; 222/570; 222/573

[58] Field of Search ..... 222/566, 567, 568, 570, 222/573, 575, 526, 528, 530, 531, 89, 91, 520, 525; 141/382, 383; 220/85 SP

[56] References Cited

U.S. PATENT DOCUMENTS

| | | | |
|---|---|---|---|
| 1,566,597 | 12/1925 | Harman | 141/382 |
| 2,034,799 | 3/1943 | Crain | 222/568 |
| 2,445,130 | 7/1948 | Turner | 222/568 |
| 2,806,637 | 9/1957 | Wallingford | 222/568 |
| 3,096,911 | 7/1963 | Finch et al. | 222/570 |
| 3,168,969 | 2/1965 | Krieps | 222/520 |
| 3,323,693 | 6/1967 | Miller | 222/570 |
| 3,439,843 | 8/1969 | Corsette | 222/520 |
| 3,537,623 | 11/1970 | Fisher | 222/570 |
| 4,008,738 | 2/1977 | Moskovich | 141/392 |
| 4,258,884 | 3/1981 | Rogers | 222/570 |
| 4,351,453 | 9/1982 | Walker | 222/83.5 |
| 4,568,004 | 2/1986 | Goncalves | 222/520 |
| 4,583,668 | 4/1986 | Maynard, Jr. | 222/568 |
| 4,600,125 | 7/1986 | Maynard, Jr. | 222/81 |
| 4,832,238 | 5/1989 | Taylor | 222/568 |
| 4,946,079 | 8/1990 | Campbell | 222/568 |

FOREIGN PATENT DOCUMENTS

| | | | |
|---|---|---|---|
| 1238023 | 6/1988 | Canada | 222/570 |
| 865259 | 4/1961 | United Kingdom | 222/570 |
| 1066912 | 4/1967 | United Kingdom | 222/568 |

*Primary Examiner*—Michael S. Huppert
*Assistant Examiner*—Kenneth Bomberg
*Attorney, Agent, or Firm*—Litman, McMahon & Brown

[57] ABSTRACT

A detachable pouring spout generally adapted for use in pouring fluid from a container having an externally threaded neck which can be closed with an internally threaded reclosable cap. The spout has a tubular body with proximate and distal ends and a coupling associated with each end. The proximate end coupling, preferably a female coupling, detachably connects the spout to the container by forming a substantially fluid-tight friction connection with the neck of the container. The distal end coupling, a male coupling comprised of external threads near the distal end of the body, is preferably adapted to threadedly engage the reclosable cap of the container. The spout may also include one or more externally protruding annular rings near the distal end of the body which contact the lip of a fluid delivery aperture and prevent the spout from slipping therefrom.

4 Claims, 1 Drawing Sheet

DETACHABLE POURING SPOUT

BACKGROUND OF THE INVENTION

1. Field of the Invention

The present invention relates generally to fluid pouring spouts. More particularly, the present invention relates to a detachable pouring spout for use in pouring fluids from containers having externally threaded necks and internally threaded reclosable caps.

2. Description of the Prior Art

Liquid containers can be of blow molded plastic construction and can be used to contain a variety of fluids. For example, these containers can be used in place of oil cans with sides constructed of paper and metal tops and bottoms. Like oil cans, the plastic containers are not sized and shaped to adapt to the various fluid delivery aperture configurations found in internal combustion engines so as to allow the delivery of fluid directly from the container to the engine without spillage. In order to alleviate this problem, a variety of detachable pouring spouts have been developed.

An example of a detachable pouring spout is found in U.S. Pat. No. 4,351,453. This patent describes a spout of rigid construction that is equipped with a container piercing blade at one end and is intended for use in pouring oil from metal topped can containers. Additionally, this spout has an interior butterfly valve which can be used to retard or completely stop oil flow through the spout. Once the spout is inserted into the oil can with the valve in its closed position, the free end of the spout is positioned in the oil delivery aperture before the valve is opened to allow oil flow through the spout. This procedure avoids the spillage which occurs when the spout and container combination is initially tilted and directed toward the oil delivery aperture for insertion.

Detachable pouring spouts have also been developed for plastic containers having externally threaded necks and internally threaded reclosable caps. Pouring spouts having flexible bodies and threaded ends have been described in several U.S. Pat. e.g. Nos. 4,583,668; 4,832,238; 4,600,125. Some of these spouts can be constructed, at least in part, of accordion fold snap lock segments. A spout can threadedly connect to a container directly (U.S. Pat. No. 4,832,238); through an adapter capable of connecting a spout to containers having threaded outlets of differing diameters (U.S. Pat. No. 4,583,668); or through another segment of a spout as a flexible extension (U.S. Pat. No. 4,600,125). A butterfly valve for regulating the flow through a spout has been incorporated with a flexible spout (U.S. Pat. No. 4,832,238). Also, a cap fitted for the free end of a spout has been provided to prevent spills and contamination when a container is stored with the spout still attached (U.S. Pat. Nos. 4,832,238 and 4,583,668).

The prior art previously described has several deficiencies. Some flexible bodied spouts which threadedly connect to containers can be reoriented relative to the containers, but may be unable to provide the "hands free" pouring afforded by spouts of rigid construction. On the other hand, use of a threaded spout-container connection in conjunction with a rigid spout restricts the position of the spout relative to the container. Moreover, when multiple containers of fluid must be poured, as is often required, using a threaded spout-container connection can require extra time in connecting and disconnecting the spout. Butterfly valves and spouts of flexible construction are useful in preventing the spillage that often occurs when the spout and container combination is initially tilted for insertion into the delivery aperture, but such features unnecessarily add to the cost and complexity of the spout. Finally, some of the rigid spouts of the prior art afford "hands free" pouring but may slip from wide delivery apertures if left unattended.

The foregoing disadvantages of the prior art are indicative of the strong need for improvement in this relatively simple yet necessary field of invention. The present invention addresses these problems attributable to the prior art while remaining relatively simple and inexpensive to construct.

SUMMARY OF THE INVENTION

The improved detachable pouring spout of the present invention is intended for use in pouring fluid from a container having an externally threaded neck which can be closed with an internally threaded reclosable cap. The spout has a tubular body with both proximate and distal ends. A proximate end coupling means detachably connects the spout to the container and is preferably a female coupling. This female coupling may include a tubular sleeve which mates interferingly with the external threads on the neck of the container in a substantially fluid-tight friction connection. The female coupling may also include an annular groove within the sleeve which can engage externally protruding rings on the neck of the container to more securely connect the spout to the container. The friction connection provides a quick means of connecting the spout and the container and allows the female coupling to rotate about the neck of the container so that the spout can be oriented freely relative to the container without requiring a flexible-bodied spout. A distal end coupling means is preferably a male coupling which includes external threading near the distal end of the body. The external threading is preferably sized to threadably engage the reclosable cap of the container so that the spout-container combination can remain connected during storage without danger of spillage or contamination. Also, this allows the external threads on the distal end of a first spout to detachably engage the sleeve of the female coupling of a second spout in a substantially fluid-tight connection in order to create a longer spout.

The spout of the present invention is specially adapted to provide "hands free" pouring. The spout is preferably of rigid construction and capable of bearing the weight of the container while the spout-container combination is inverted and inserted in the fluid delivery aperture. The female coupling may include a flared tubular skirt attached to the end of the sleeve opposite the body of the spout to help bear the weight of the container so that the spout-container connection is not undermined. Also, one or more externally protruding annular rings located near the distal end of the body may be used to prevent the spout from slipping out of the fluid delivery aperture while unattended. Finally, the simple singular piece design of the present invention allows the spout to be manufactured inexpensively by a plastic blow molding process.

Objects and Advantages of the Preferred Embodiment

The principal objects of the invention are: to provide an improved detachable pouring spout for use in conjunction with a fluid container having an externally threaded neck which can be closed with an internally threaded reclosable cap; to provide such a spout which can be quickly yet securely attached to a container; to provide such a spout which can be freely oriented relative to the container without requiring a flexible body; to provide such a spout which is capable of securely engaging another such spout to create a longer spout; to provide such a spout which is capable of providing "hands free" pouring; to provide such a spout which is relatively inexpensive to manufacture and particularly well suited for the intended use thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
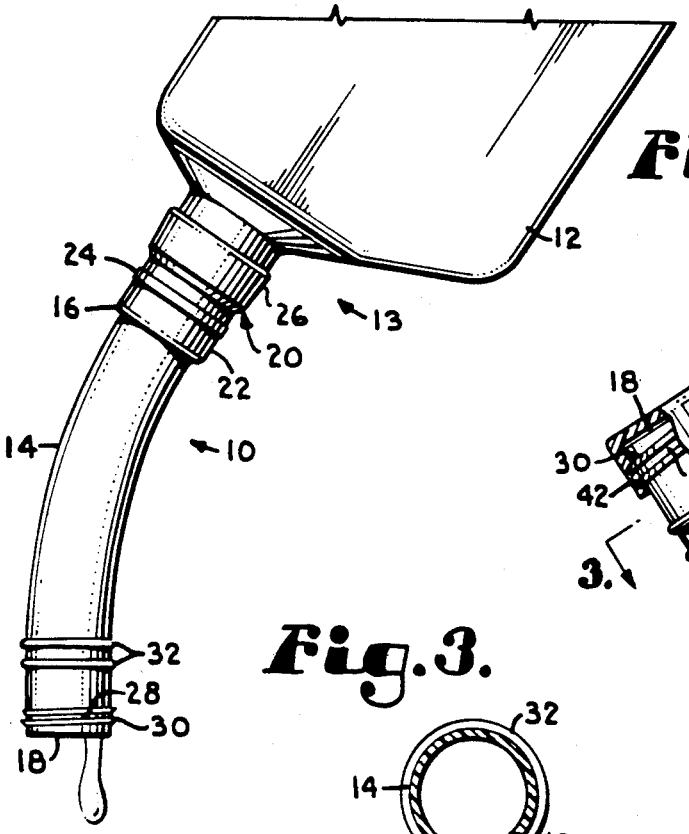
FIG. 1 is a side elevational view of a detachable pouring spout in accordance with a preferred embodiment of the present invention in connected relationship with a fluid container.

With reference now to the drawings, and in particular FIG. 1, an improved detachable pouring spout 10 in accordance with a preferred embodiment of the present invention is shown in connected relationship with a fluid container 12. The spout 10 and container 12 combination 13 is inverted for pouring. The spout 10 generally comprises a rigid, substantially curved tubular body 14 having proximate 16 and distal 18 ends. Associated with the proximate end 16, is a proximate coupling means which includes a female coupling 20. The female coupling 20 comprises a tubular sleeve 22 with an annular groove 24 and a tubular skirt 26. Associated with the distal end 18, is a distal coupling means which includes a male coupling 28 comprised of external threads 30 near the distal end 18 of the body 14. Also, near the distal end 18 of the body 14 is at least one externally protruding annular ring 32.

Figure 2:
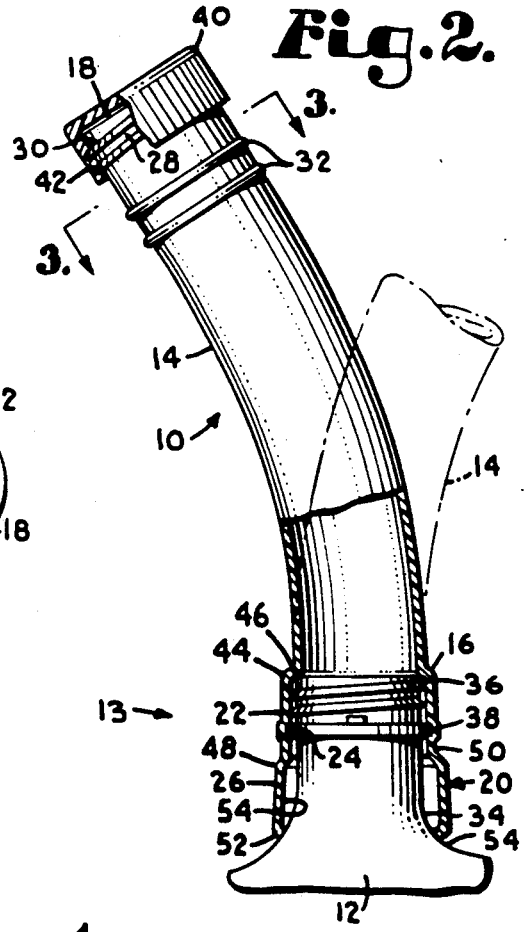
FIG. 2 is an enlarged, side elevational view of the spout in connected relationship with the container shown in FIG. 1 with portions of the spout broken away to reveal details of the connection; the spout is shown in a first selected position relative to the container in solid lines and in a second selected position relative to the container in phantom lines.

FIG. 2 is an enlarged, side elevational view of the spout 10 in connected relationship with the container 12. A portion of the spout 10 has been broken away to reveal the connection between the spout 10 and container 12. The container 12 has a tubular neck 34 with external threads 36 and an externally protruding annular ring 38. A reclosable cap 40 with internal threads 42 is adapted to threadedly engage the external threads 36 of the neck 34.

The female coupling 20 is used to detachably connect the spout 10 to the container 12. The sleeve 22 has an inside diameter larger than an inside diameter of the body 14 and has a first sleeve end 44 connected to the proximate end 16 of the body 14. The sleeve 22 is adapted to engage the external threads 36 on the neck 34 of the container 12 in a substantially fluid-tight friction connection 46. The friction connection 46 is quickly and easily established by urging the female coupling 20 over and onto the neck 34 of the container 12. The reduced inside diameter of the body 14, as compared to the sleeve 22, prevents the neck 34 of the container 12 from entering the spout 10 past the proximate end 16 of the body 14. The annular groove 24 within the sleeve 22 is adapted to mate interferingly with the annular ring 38 on the neck 34 of the container 12 to provide a more secure connection between the spout 10 and the container 12.

The tubular skirt 26 of the female coupling 20 has an inside diameter larger than an inside diameter of the sleeve 22 and has a first skirt end 48 connected to a second end 50 of the sleeve 22. Preferably, the skirt 26 is flared such that an inside diameter of the skirt 26 near the first skirt end 48 is smaller than an inside diameter near a second end 52 of the skirt 26. The skirt 26 helps bear the weight of the container 12 when the spout 10/container 12 combination 13 is inverted so that the weight of the container 12 is distributed to and bears against the interior surface 54 of the skirt 26. This helps prevent the weight of the container 12 from separating the friction connection 46 during "hands free" pouring.

The friction connection 46 between the female coupling 20 and the neck 34 of the container 12 does not restrict the orientation of the body 14 relative to the container 12. The female coupling 20 is free to rotate about the neck 34 of the container 12 while the spout 10 and container 12 are connected. As shown by the phantom lines in FIG. 2, this allows the body 14 of the spout 10 to be selectively positioned relative to the container 12. The spout 10/container 12 combination 13 can thereby be adapted to conform to the physical environment surrounding a fluid delivery aperture, reducing the possibility of spillage.

The external threads 30 near the distal end 18 of the spout 10 which comprise the male coupling 28, are adapted to threadedly engage the internal threads 42 of the reclosable cap 40 of the container 12. The cap 40 can thereby be used to close the distal end 18 of the body 14 as shown in FIG. 2. This prevents spillage or contamination from occurring while the spout 10/container 12 combination 13 remains connected during storage.

Figure 3:
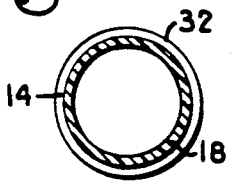
FIG. 3 is a cross-sectional view of the spout taken generally along line 3—3 in FIG. 2
Figure 4:
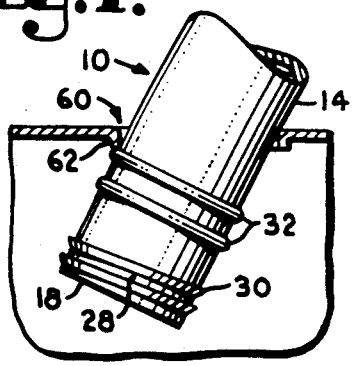
FIG. 4 is a fragmentary side elevational view of the spout inserted in a fluid delivery aperture.

The annular rings 32 located near the distal end 18 of the body 14 are axially displaced from each other and from the male coupling 28 closer to the proximate end 16 of the body 14. In FIG. 3, the annular rings 32 are shown protruding externally from the body 14. The function of the annular rings 32 is depicted in FIG. 4, which shows the spout 10 inserted in a fluid delivery aperture 60. The annular rings 32 contact a lip 62 of the aperture 60 and thereby prevent the spout 10 from slipping out of the aperture 60 during "hands free" pouring.

Figure 5:
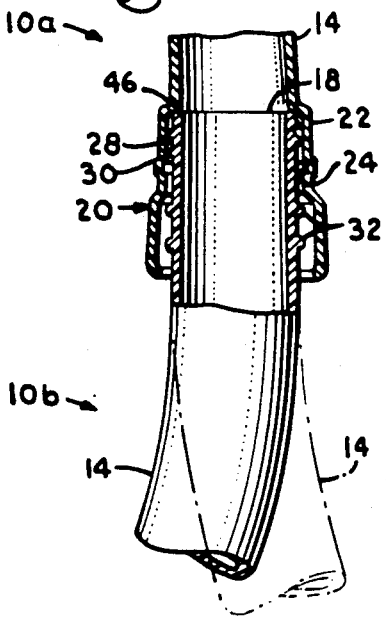
FIG. 5 is a fragmentary side elevational view of a spout in accordance with the present invention in connected relationship with a second such spout with portions of the spouts broken away to reveal details of the connection; one of the spouts is shown in a first selected position relative to the other spout in solid lines and in a second selected position relative to the other spout in phantom lines.

Adapting the male coupling 28 to accept the cap 40 of the container 12 renders the distal end 18 of the body 14 substantially similar in size and shape to the neck 34 of the container 12. This allows two or more spouts 10 to be detachably connected (FIG. 5). FIG. 5 shows first and second spouts 10*a* and 10*b*, respectively, in connected relationship. The spouts 10*a*, 10*b* are in accordance with the present invention and contain the same subparts as the spout 10 previously described and shown in FIGS. 1–4. A portion of the spouts 10*a*, 10*b* has been broken away to reveal the detail of the spout 10*a*/spout 10*b* connection.

The two spouts 10*a*, 10*b* are connected by urging the female coupling 20 of the first spout 10*a* over and onto the distal end 18 of the second spout 10*b*. The sleeve 22 of the first spout 10*a* thereby engages the external threads 30, which comprise the male coupling 28 of the second spout 10*b*, in a substantially fluid-tight friction connection 46. The friction connection 46 between the two spouts 10*a*, 10*b* is substantially similar to the friction connection 46 between the spout 10 and the container 12 as shown in FIG. 2.

One of the annular rings 32 near the distal end 18 of the second spout 10*b* could be positioned so as to mate interferingly with the annular groove 24 within the sleeve 22 of the first spout 10*a*. The friction connection 46 between the two spouts 10*a*, 10*b* allows the distal end 18 of the second spout 10*b* to rotate freely within the female coupling 20 of the first spout 10*a*. As shown by the phantom lines in FIG. 5, this allows the body 14 of the second spout 10*b* to be selectively oriented relative to the first spout 10. The spouts 10*a*, 10*b* thereby provide a longer spout 10*a*/spout 10*b* combination that is readily adaptable to relatively inaccessible fluid delivery apertures and which reduces the possibility of spillage while pouring.

The spout 10 can be suitably adapted to detachably connect to fluid containers 12 having externally threaded necks 34 of varying size and which are used to contain a variety of fluids.

It is to be understood that while certain forms of the present invention have been illustrated and described herein, it is not to be limited to the specific forms or arrangement of parts described and shown.

What is claimed and desired to be secured by Letters Patent is as follows:

1. In combination with a fluid container having a male-threaded tubular neck with at least one externally protruding annular ring axially displaced from said male-threading nearer said container and a female-threaded cap threadedly mountable on said neck for closing said container, the improvement of a detachable spout, wherein said spout comprises:

(a) a tubular body with a proximal end and a distal end;

(b) a female coupling associated with said proximal end and including:

(1) a tubular sleeve with an inside diameter greater than an inside diameter of said body and adapted to detachably engage said male threading and said neck in a substantially fluid-tight engagement; said sleeve having a first end connected to said proximal end of said body; and (2) an annular groove within said sleeve adapted to detachably engage said protruding ring on said neck;

(c) a male coupling associated with said distal end of said body and including external threads near said distal end selectively, threadably engagable with said female threaded cap;

(d) a first externally protruding annular ring near said distal end of said body axially displaced from said male coupling nearer said proximal end of said body;

(e) a second externally protruding annular ring near said distal end of said body axially displaced from said first ring nearer said proximal end of said body; and (f) a tubular skirt with an inside diameter larger than an inside diameter of said sleeve; said skirt having a first end connected to a second end of said sleeve.

2. The improvement of claim 1 wherein:

(a) said skirt is flared such that an inside diameter of said skirt near said first end is smaller than an inside diameter near a second end of said skirt.

3. A detachable spout for connection to a fluid container with a male-threaded tubular neck with an externally protruding annular ring and a female threaded cap, which comprises:

(a) a tubular body with a proximal end and a distal end;

(b) a female coupling associated with said proximal end and including:

(1) a tubular sleeve with an inside diameter greater than an inside diameter of said body and adapted to detachably engage said male threading and said neck in a substantially fluid-tight engagement; said sleeve having a first end connected to said proximal end of said body; and (2) an annular groove within said sleeve adapted to detachably engage said protruding ring on said neck;

(c) a male coupling associated with said distal end of said body and including external threads near said distal end selectively, threadably engagable with said female threaded cap;

(d) a first externally protruding annular ring near said distal end of said body axially displaced from said male coupling nearer said proximal end of said body;

(e) a second externally protruding annular ring near said distal end of said body axially displaced from said first ring nearer said proximal end of said body; and (f) a tubular skirt with an inside diameter larger than an inside diameter of said sleeve; said skirt having a first end connected to a second end of said sleeve.

4. In combination with a fluid container having a male-threaded neck with at least one externally protruding annular ring axially displaced from said male-threading nearer said container and a female-threaded cap threadedly mountable on said neck for closing said container, the improvement of a plurality of detachable spouts, an innermost one of said spouts being connectable to said container neck and said spouts being serially and fluidically interconnectable, wherein each said spout comprises:

(a) a tubular body with a proximal end and a distal end;

(b) a female coupling associated with said proximal end and including:

(1) a tubular sleeve with an inside diameter greater than an inside diameter of said body and adapted to detachably engage said male threading and said neck in a substantially fluid-tight engagement; said sleeve having a first end connected to said proximal end of said body; and (2) an annular groove within said sleeve adapted to detachably engage said protruding ring on said neck;

(c) a male coupling associated with said distal end of said body and including external threads near said distal end selectively, threadably engageable with said female threaded cap;

(d) a first externally protruding annular ring near said distal end of said body axially displaced from said male coupling nearer said proximal end of said body;

(e) a second externally protruding annular ring near said distal end of said body axially displaced from said first ring nearer said proximal end of said body; and (f) a tubular skirt with an inside diameter larger than an inside diameter of said sleeve; said skirt having a first end connected to a second end of said sleeve.

* * * * *